United States Patent [19]

Kirkbride

[11] 4,153,533

[45] May 8, 1979

[54] SHALE CONVERSION PROCESS

[76] Inventor: Chalmer G. Kirkbride, 13 Elk Forest, R.D. #2, Elkton, Md. 21921

[21] Appl. No.: 831,171

[22] Filed: Sep. 7, 1977

[51] Int. Cl.[2] ..... C10B 53/06; C10G 11/04

[52] U.S. Cl. ..... 208/11 R; 201/19

[58] Field of Search ..... 208/11 R; 201/19

[56] References Cited

U.S. PATENT DOCUMENTS

| | | | |
|---|---|---|---|
| 2,630,306 | 3/1953 | Evans | 208/11 R |
| 3,449,213 | 6/1969 | Knapp et al. | 201/19 |
| 3,484,364 | 12/1969 | Hemminger | 208/11 R |
| 3,652,447 | 3/1972 | Yant | 208/11 R |
| 3,843,457 | 10/1974 | Grannen et al. | 201/19 |
| 3,922,215 | 11/1975 | Linden et al. | 208/11 R |
| 3,925,190 | 12/1975 | Whitcombe et al. | 208/11 R |

*Primary Examiner*—Herbert Levine

*Attorney, Agent, or Firm*—Dann, Dorfman, Herrell and Skillman

[57] ABSTRACT

A process for converting the kerogen of oil shale to oil products is provided, which includes subjecting a mixture of oil shale and hydrogen to the influence of wave energy in the microwave range.

7 Claims, No Drawings

SHALE CONVERSION PROCESS

BACKGROUND OF THE INVENTION

The conversion of the kerogen of oil shale to oil-like products has long been desired. This conversion is now technically but not economically feasible by the process of distructive distillation, or retorting. In retorting, the kerogen molecules are believed to be cracked from attachment to inorganic matter of the shale to form heavy, highly unsaturated, highly viscous fluids. These fluids must be further processed as by further cracking, hydrocracking, hydrogenation, or otherwise, including means to remove sulfur compounds, to obtain useable products. The very high temperatures required by retorting (about 800° F. to 1500° F.) and the apparatus thereby required, and in addition the additional refining necessary, makes the process economically unattractive.

An object of the invention is to provide a novel process for converting the kerogen of shale to valuable oil products in a facile and economical manner.

A further object is to provide a process for converting kerogen to oils having little or no sulfur content.

A still further object is to provide a process for converting kerogen directly to valuable oleaginous products boiling largely in the lubricating oil or gas oil range.

In an embodiment of the invention, shale particles are dried, mixed with hydrogen at an elevated pressure, and the mixture subjected to wave energy in the microwave range. Under the influence of the microwaves, the kerogen is split from inorganic matter and the sulfur present converted to hydrogen sulfide so that substantially sulfur-free, relatively saturated oleaginous products are obtained. Reference is made to my co-pending patent application Ser. No. 831,170, filed Sept. 7, 1977 which is directed to the use of coal in a similar process in which sulfur is removed from coal by the formation of hydrogen sulfide.

DETAILED DESCRIPTION OF THE INVENTION

The oil shales (hereinafter "shale") used in the process of the invention are found in deposits occurring in many countries of the world. The shales of the Green River formation in Colorado, Utah and Wyoming are among the most significant and illustrate the many deposits in the United States. Shale is sedimentary rock with a relatively high organic content (30 to 60% by weight volatile matter and fixed carbon). When heated in the absence of air a yield of from about 20 to 50 gallons of a viscous crude oil per ton of shale is obtained. The organic matter, or kerogen, of the shale is believed to exist between particles of inorganic matter, and some portion thereof, believed small, may be directly or chemically bonded to mineral constituents. The inability of the usual organic solvents to remove kerogen from shale and the failure of usual ore-dressing techniques (sink-float) to result in appreciable enrichment in organic matter is believed to indicate that most of the kerogen is held to the inorganic matter of the shale by bonds stronger than mere physical adsorption.

For use in the process of the invention, the shale is first crushed, ground, or otherwise pulverized to a desired particle size suitable for the type of operation to be used, which usually will be a fixed, moving, or fluidized bed operation. For fixed bed operation, a size that will pass a six inch screen mesh can be used, but preferably smaller sizes down to about one-eighth inch are used. Advantageously an average particle diameter of from 1 to 2 inches is used in fixed bed operations. For moving bed operations, particles having an average diameter of one-eighth inch typically will be used, and for fluidized operations, the particles typically will be powder size and may have average diameters as low as 10 microns.

In accordance with the present invention, it is desirable to have the free moisture content of the shale at a low level for use in the process to prevent an inefficient use of energy. By "dry shale," and terms of similar import, is meant shale from which moisture has been substantially removed. While it is not desired to be bound by theoretical considerations, it is believed that the kerogen molecules are held to the inorganic matter of the shale by forces or bonds stronger than mere physical adsorption, as stated above. In the present process, it is believed, the microwaves cause localized temperature rises at the situs of the kerogen-shale bond or connection and activates the inorganic atom at the connection situs so that a cleavage of the organic carbon of the kerogen from the inorganic matter is obtained. As used herein, "organic carbon" means the carbon atoms in the kerogen molecule as opposed to those in the inorganic portions of the shale, such as in carbonates. The microwaves also activate the water molecules of any free moisture so that, with free moisture distributed throughout the shale particles, an overall temperature rise will result, which is an inefficient use of microwave energy. It is further believed that the wave energy causes a localized temperature rise at the situs of each sulfur atom present and activates the sulfur atoms so that they react with the adjacent hydrogen to form hydrogen sulfide which is removed as a gas.

The form in which sulfur exists in kerogen is not known with certainty. A generalized composition for kerogen (in percent) is: carbon 66–88; hydrogen 7.1–12.8; nitrogen 0.1–3.0; sulfur 0.1–8.8; and oxygen 0.75–27.4. The sulfur probably forms part of a complex, heterocyclic molecule, possibly as thiophene portions of the molecule. What is known is that the sulfur content of kerogen is substantially reduced in the present process.

The shale may be dried by any convenient means. Preferably the shale particles to be used are heated to about 250° F. to drive off free moisture. Depending on the particle size and agitation of the particles, which may require from about 15 to 60 minutes. This time and temperature can be substantially and advantageously reduced by applying a vacuum while heating. Other drying techniques which are known to those skilled in the art, such as by passing a dried inert gas through the heated bed of shale particles, gives good results. Suitable gases are inert gases will not react with kerogen including nitrogen and hydrogen. Shale may initially contain from about 1 to 30% by weight or more of moisture, and to secure the advantages of the present process, the moisture content must be reduced to not more than 0.5%, and preferably to below 0.2% by weight. An exception is where an increase in the temperature of the entire shale mass is desired so that the hydrogen-kerogen mixture is at a higher temperature when subjecting to microwaves. This is useful where it is desired that the products have a reduced olefinic content, i.e., the overall temperature increase aids in saturating with hydrogen the unsaturated bonds of the complex kerogen molecules to form oleaginous products. A cracking of the kerogen molecules may also be obtained under such elevated temperatures to decrease the molecular weight and the viscosity of the products. Where this is desired, the moisture content of the shale may be as high as 3% to give a temperature rise to from ambient to about 300° to 600° F. when operating within the defined time limits. Temperatures above 600° F. should be avoided as giving increasingly severe cracking to undesirable gaseous products. The products obtained at the elevated temperatures of 300° F. to 600° F. appear more saturated, less viscous, and easier to further refine than would be otherwise obtained.

The dry shale is admixed with hydrogen usually at an elevated pressure and subjected to the influence of wave energy in the microwave range. The pressure will usually vary from about 5 psi to 1,000 psi, depending largely on the size of the shale particles, it being remembered that an intimate mixing of shale and hydrogen is necessary, i.e., on subjecting the shale to microwaves, hydrogen must be in the immediate vicinity of the kerogen-inorganic bond and of the activated sulfur atoms for reaction to break the bonds and to cause the sulfur-hydrogen reaction to occur. Thus, with small shale particles, say those having an average diameter of two inches or less, and a hydrogen pressure of from atmospheric to 100 psi gives good results, whereas with larger shale particles, say those having an average diameter of 2 inches, a hydrogen pressure of from 200 psi to 500 psi and even more, say up to 10,000 psi, gives good results as the diffusion of hydrogen into the shale particles is enhanced with increasing pressure.

The time of exposure of the shale-hydrogen admixture to microwaves is dependent upon the intimacy of association of the hydrogen and the inorganic atom or atoms at the shale-kerogen bond, and of the hydrogen and sulfur atoms where sulfur is simultaneously converted to hydrogen sulfide. Thus, with relatively small shale particles and relatively high hydrogen pressure, short exposure time is sufficient to activate the atoms at the bonds and cause a cleavage thereof. As has been found, under conditions causing the desired cleavage, the sulfur will react with the adjacent hydrogen molecules to form hydrogen sulfide. A time of from 0.25 to 2 minutes generally will be used with good results, but shorter times where good hydrogen intimacy with the bond situs is obtained, say down to about 0.1 second. With larger shale particles and/or lower hydrogen pressure, as much as 10 minutes may give optimum results, but even longer times of up to about 1 hour may be used where the shale particles are relatively large and/or hydrogen diffusion into the particles is incomplete. Times in excess of one hour should be avoided as an inefficient use of energy.

The temperature to employ during exposure of the dry shale and hydrogen admixture to wave energy is not critical to the process. It is believed that the activation of the molecules and possibly very localized temperature rises, namely in the immediate vicinity, or situs, of the kerogen-inorganic material bond and of the sulfur atoms, as herein described, makes unimportant the overall temperature of the shale particles or bed. Accordingly, ambient temperature is advantageously used. Where shale drying is at an elevated temperature and exposure of the dry shale-hydrogen to wave energy follows soon thereafter, the elevated temperature may assist the cleavage and desulfurization reactions to an extent. Also, elevated temperatures may be desired to help achieve desired products and can be obtained by adjusting the free moisture content of the shale to a level higher than would be otherwise used, as above described.

The wave energy to use in the present process is in the microwave range and may be from 1 megacycle per second to 1,000 gigacycles per second ($10^6$ to $10^{12}$ cycles per second, respectively). These frequencies may be expressed using the Hertz (Hz) Unit, and are the same as from 1 megahertz (1 MHz) to 1,000 gigahertz (1,000 GHz). As used herein, "megacycles" means "megacycles per second" unless otherwise stated. With some shales it may be advantageous to use two or three or even more frequencies simultaneously or consecutively, as this may be the most efficient operation. While again it is not desired to be limited by theoretical considerations, it is believed that a single frequency does not give optimum activation of all types of kerogen-inorganic matter bonds. Thus, the bond located at a clay portion of shale may receive maximum activation at one frequency, say 18 megacycles, while the bond located at a quartz or mica portion of shale may receive maximum activation at different frequencies, say 30 or 60 megacycles. For simultaneous operation, the same shale is subjected to wave energy of different frequencies at different times, usually one immediately following the other. An alternative means for consecutive operation which is especially useful where moving or fluidized bed operations are used is to space wave energy sources of different frequencies along the path of the shale particle flow in the reactor. When using different frequencies, the total time of exposure of the shale to the wave energy will be relatively short because of the high efficiency of the operation, so that times of exposure in the lower portions of the defined range give good results. The desirability of using a multiplicity of wave energy sources and the frequencies to use are best determined by experimentation for a given shale.

The equipment for generating microwaves is well known to those skilled in the art. Continuous wave magnetrons with accompanying electronic equipment gives good results, and the choice and use of such equipment will be apparent to those skilled in the art.

Nitrogen occurring as a component of the complex kerogen molecule probably exists as an occasional heterocyclic ring and to some extent as amine groups. As above discussed for sulfur, nitrogen can also be removed in the present process by the reaction of the nitrogen atoms, activated by the microwaves, with hydrogen to form ammonia which is removed in the gas phase from the shale. When it is desired to reduce the nitrogen content of shale, together with the sulfur, operation should be in the upper pressure range to achieve good results. Pressures of above about 2,500 psi give good results, with the amounts removed becoming smaller at lower pressures. This ammonia may be recovered by known means, such as fractionation, from the effluent gases and forms a valuable product, e.g., it can be used as low cost fertilizer.

An embodiment of the invention involves the in situ production of oleaginous products from shale, which is especially useful where a substantial overburden makes strip mining unattractive. In this embodiment, a portion of a shale bed under a substantial overburden is mined mechanically by shale removal through a shaft to the ground surface. About one-fourth of the shale volume is removed using pillow and room mining; pillows are shale columns left as support for the ceiling of the mined-out rooms. During or after the mining, sumps are spaced in the floor of the cavern into which liquids formed in or entering the cavern will flow. Conduits extend into the sumps and terminate above ground level for recovery of the liquids. On completion of the mechanical mining, the pillows are converted to rubble by explosives. The rubble particles may be of any size but usually are from about 6 to 12 inches in diameter. The shale rubble (and cavity walls, ceiling and floor where composed of shale) will contain free moisture and should be dried to within the limits herein defined. In this embodiment, however, an elevated temperature is helpful in cracking the kerogen to lower molecular weight and lower viscosity products so that the products will more readily flow by gravity into the sumps and be recovered therefrom through appropriate conduits and pumping means. It is therefore desirable to leave the free moisture content as high as 3% by weight, and the range of from 0.5 to 3% by weight gives good results. This moisture level will generally cause the temperature of the rubble being exposed to microwaves to increase to about 300° F. to 600° F. to aid the cracking reaction. The drying of the shale to the desired level is conveniently accomplished by introducing dry, preferably heated hydrogen into the cavity and removing wet hydrogen at a point or points remote from the introduction location. The wet hydrogen is dried as by contact with a desiccant or other known means, preferably heated, and recirculated through the rubble.

On completion of the shale drying to the desired extent, the hydrogen atmosphere is maintained in the cavity and the rubble-hydrogen mixture subjected to microwaves. An elevated hydrogen pressure is advantageously used, as herein described. The microwave source or sources are advantageously located in the cavity and operated remotely from the ground surface. A plurality of sources is advantageously provided so that the simultaneous application of two or more microwave frequencies can be used, as hereinabove described. Because of the formation of hydrogen sulfide, water vapor, and ammonia (if operation is under relatively high pressure), hydrogen contaminated therewith is continuously or intermittently removed from the cavity, the hydrogen purified, and the purified hydrogen recycled to the process.

Because of the rubble size, exposure to the microwaves will be considerably longer than the times above described, and will depend on several variables including the rubble size, the power of the microwaves in penetrating the rubble, the number of microwave sources, and the like. It is believed that kerogen at or near the rubble surfaces first reacts by bond cleavage, removal of sulfur, and partial saturation of olefinic bonds to form heavy fluid products which, especially where some cracking is obtained, are oleaginous products having the appearance and characteristics of a heavy lubricating oil. The fluid products, or oleaginous material, then flows slowly from the rubble into the sumps, so that kerogen located further from the rubble surfaces can contact the hydrogen entering the rubble interstices. Reaction between this hydrogen and the kerogen deeper in the rubble occurs under the influence of the continuing microwaves. This continuing process ultimately substantially depletes the shale of kerogen. A time of weeks or months may be required, and even many months, say up to six months, can be effective and economically attractive. The oleaginous products are recovered through appropriate conduits extending into the sumps and to above ground level. Where elevated hydrogen pressure is used, such elevated pressure may be used at least in part to raise the liquid products to the surface, thereby assisting any pumping that may be used.

The following Examples illustrate the process of the invention, in which "Assay" is a measure of the oil content of the shale in gallons per ton of shale (Fischer Assay); "gal/ton" means "gallons per ton of shale;" and "wt %" means "percent by weight:"

EXAMPLE 1

Western shale, having an Assay of 30 and organic carbon content of 13.6 wt %, is retorted at 1200° F. A yield of 28.5 gal/ton of 21° API oil having 90° F. pour point is obtained. The sulfur content of this oil is 1.0 wt % and the nitrogen content 1.7 wt %.

EXAMPLE 2

The same shale used in Example 1 is ground to a size to pass through a 2 inch screen, then dried at 250° F. for 40 minutes to a moisture content of 0.1 wt %. The dried shale is put under hydrogen pressure of 250 psi in an autoclave reactor. It is then exposed to a 2.5 megacycle microwave for two minutes. A yield of 39 gal/ton of 31° API oil is obtained having a pour point of 55° F. The sulfur content is 0.01 wt % and nitrogen content 1.7 wt %.

EXAMPLE 3

The shale in Example 1 is processed in the same way as in Example 2 except that the hydrogen pressure is 25 psi. The yield of oil is 35 gal/ton of 28° API. The sulfur content is 0.1 wt % and the nitrogen 1.7 wt %.

EXAMPLE 4

The shale in Example 1 is processed in the same way except at a hydrogen pressure of 2,500 psi. The yield of oil is 41 gal/per ton of 32° API and pour point of 50° F. The sulfur content is 0.005 wt % and the nitrogen content 0.1 wt %.

EXAMPLE 5

Shale of the Devonian type from Kentucky, having an Assay of 10 and an organic carbon content of 13.5 wt % is retorted at 1200° F. A yield of 10 gal/ton of 18° API oil of 95° F. pour point is obtained. The sulfur content is 1.2 wt % and the nitrogen 0.5 wt %.

EXAMPLE 6

The same shale as in Example 5 is ground to a size to pass through a 2 inch screen and then dried at 250° F. for 40 minutes to a moisture content of about 0.2 wt %.

The dried shale is then put under 250 psi hydrogen pressure and exposed to 2.5 megacycle microwave for two minutes. A yield of 30 gal/ton of 25° API oil is obtained, having a pour point of 60° F. The sulfur content is 0.01 wt % and the nitrogen 0.5 wt %.

EXAMPLE 7

The shale of Example 5 is processed as in Example 6 except at a hydrogen pressure of 2,500 psi. A yield of 30° API oil of 32 gal/ton is obtained. The sulfur content is 0.005 wt % and the nitrogen 0.01 wt %.

EXAMPLE 8

The shale of Example 5 is processed as in Example 6 except that it is simultaneously exposed to microwaves of 18 megacycles, 2.5 megacycles and 50 megacycles for one-half minute. The yield of oil is 32 gal/ton of 30° API, 0.005 wt % sulfur and 0.01 wt % nitrogen.

What is claimed is:

1. Process for recovering oleaginous products from oil shale which comprises drying oil shale particles to a free moisture content of less than 3.0% by weight, admixing the dried shale particles with hydrogen, and subjecting, at a temperature of less than 600° F., the shale-hydrogen mixture to microwave energy.

2. Process according to claim 1 wherein the free moisture content of the shale is reduced below 0.5 by weight in the drying step.

3. Process according to claim 1 wherein the microwave energy is from 1 megacycle per second to 1,000 gigacycles per second.

4. Process according to claim 1 wherein oil shale in situ is dried to a moisture content of below about 3% by weight, and a mixture thereof with hydrogen subjected to microwave energy.

5. Process for recovering oleaginous products from oil shale which comprises drying oil shale particles to a free moisture content of below 3.0% by weight, mixing the dried shale particles with hydrogen, and subjecting, at a temperature of less than 600° F., the shale-hydrogen mixture to microwave energy wherein the microwave energy is comprised of at least two frequencies.

6. Process according to claim 5 wherein the different frequencies of the microwave energy are applied simultaneously.

7. Process according to claim 5 wherein the different frequencies of the microwave energy are applied consecutively.

* * * * *